United States Patent [19]

Jiruse et al.

[11] Patent Number: 4,736,938

[45] Date of Patent: Apr. 12, 1988

[54] SUCTION FEEDER ON A PRINTING MACHINE

[75] Inventors: Jaroslav Jiruse, Blansko; Milan Konecny, Olomoucany; Vladimir Drlik, Bilovice N/Svit, all of Czechoslovakia

[73] Assignee: ZVS Adamovske strojirny, koncernovy podnik, Adamov, Czechoslovakia

[21] Appl. No.: 796,011

[22] Filed: Nov. 7, 1985

[30] Foreign Application Priority Data

Nov. 7, 1984 [CS] Czechoslovakia ..... 8451/84

[51] Int. Cl.[4] ..... B65H 3/08

[52] U.S. Cl. ..... 271/90

[58] Field of Search ..... 271/90, 103, 105, 108; 294/64.1

[56] References Cited

U.S. PATENT DOCUMENTS 3,834,558 9/1974 Bru ..... 294/64.1 X

FOREIGN PATENT DOCUMENTS 897773 5/1962 United Kingdom ..... 271/103

*Primary Examiner*—Richard A. Schacher

[57] ABSTRACT

An improved suction feeder, particularly for printing machines is disclosed, wherein higher feeding and printing speeds are made possible.

The main features of the invention is that in the body of the suction feeder is a small conduit channel and an air filling small channel which connect an inleading small channel for the bringing of pressurized air into an empty space over a small piston. In the said small conduit channel is formed a pressure spring in the upper part of said small conduit channel, and a seat in which a small ball is placed on the other end. The above described suction feeder works on the principle of the difference of air pressure above and below the small piston. While individual paper sheets are being lifted from a pile of sheets, the pressurized air is led into the empty space over the small piston, by which it instantaneously neutralizes the remaining depressurized air, leading to an instantaneous loosening of the paper sheets.

4 Claims, 2 Drawing Sheets

SUCTION FEEDER ON A PRINTING MACHINE

BACKGROUND OF THE INVENTION

This invention relates to a suction feeder, particularly on printing machines.

The object of this invention is to improve the art of suction feeders that take off individual sheets from a pile of sheets, and forwards the sheets on a printing machine. The device works on the principle that the difference in pressure found above and below the piston is such that the said suction feeder will insure an instantaneous taking off of the paper sheets thereby resulting in an improved feeding and printing speed.

DESCRIPTION OF THE PRIOR ART

One of the previously known suction feeders, see West German Pat. No. 2,321,490, is provided with a sliding lifting element which is movably arranged on the suction nozzle between two spring. The sliding lifting element is provided with reduction openings which separate the active space of the closed body of the suction feeder. A movable sliding element serves for the regulation of depressurized air which controls the movement of the sucker nozzle. A disadvantage of this apparatus is its great mechanical complexity, in that it consists of a large number of movable parts, which have friction surfaces and are therefore subject to greater possibility of failure. A further disadvantage is the inconvenience of it greater height and weight.

Another known suction feeder, see Great Britain Pat. No. 1,041,892, is provided with a piston which is rigidly connected with the sucker nozzle whereby the reduction place of the depressurized air is formed whether directly in the sucker nozzle, or is formed by an allowance between the diameter of the piston and the inner diameter of the closed cavity of the suction feeder body. The sucker nozzle is formed with the piston as one unit, whereby the shoulder part of the nozzle serves as a rigid stop. A disadvantage of said suction feeder is that when the the small piston is worn, it becomes necessary to change the whole part, including the nozzle. A further disadvantage is in that the right stop causes undesirable strokes and noises.

Another known suction feeder, see CSSR Pat. No. 189,592, has on the body a removably attached piston, in which is provided reduction openings for pressurized air. A disadvantage of this suction feeder is that for the correct function of allowing the sucker nozzle to shift out, by the effect of the depressurized air, the reduction openings in the piston must be performed in a small dimension. As a result of this, there is no instantaneous neutralization of the remaining depressurized air, and there is therefore no instantaneous taking off of the paper sheets. This is disadvantageous especially while printing at high printing speeds, where a restarted taking off of the paper sheets does not allow for the properly timed feeding of paper sheets.

SUMMARY OF THE INVENTION

The above named disadvantages are overcome by a suction feeder as is now disclosed in the present invention. In the present invention, the body of the suction feeder is provided with a small conduit channel and an air inleading small channel which connect another inleading small channel for the leading of pressurized air into an air filled space over a small piston, whereby in the small conduit channel is provided a seat, in which is placed a small ball, over which seats on with one end a pressure spring which is arranged in the upper part of the small conduit channel. A part of the small conduit channel over the seat has a larger diameter than its part formed below the seat. Between the small ball and the larger diameter of the small conduit channel is formed a necessary space for the passing of pressurized air. The small conduit channel in the suction feeder body is formed vertically and parallel with the direction of movement of the sucker nozzle, whereby the air filling small channel forms, in the upper part of the feeder body, a connection between the air filling small channel and the small conduit channel.

The advantage of the above described invention is that while individual sheets are lifted from the pile, the pressurized air is brought in the shortest way into the air filled space so that it comes to an instantaneous neutralization of the remaining depressurized air, thereby resulting in an instantaneous loosening of the paper sheets. In this way, a higher feeding and printing speed is made possible. A further advantage of the invention is that there does not arise a loss of air pressure in the by-passing ways. These and other advantages of the invention will clearly appear from the following description.

DETAILED DESCRIPTION OF THE DRAWINGS

Figure 1:
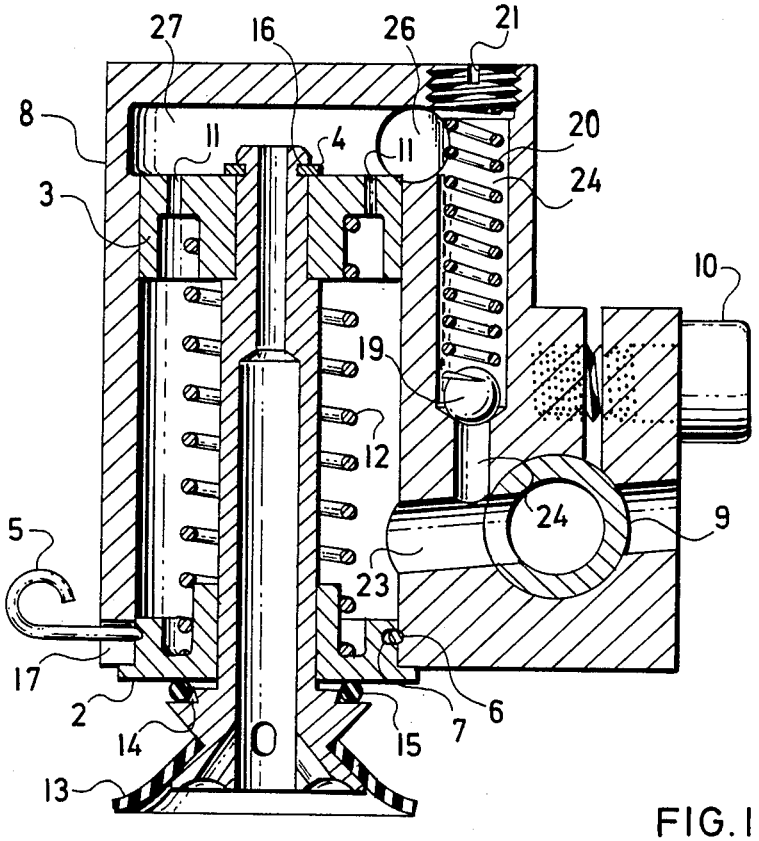
FIG. 1 shows a front view of the suction feeder in a longitudinal section, in its resting position.
Figure 2:
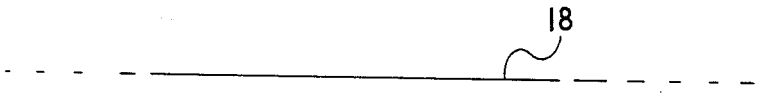
FIG. 2 illustrates a plain view of the suction feeder described in FIG. 1.
Figure 2:
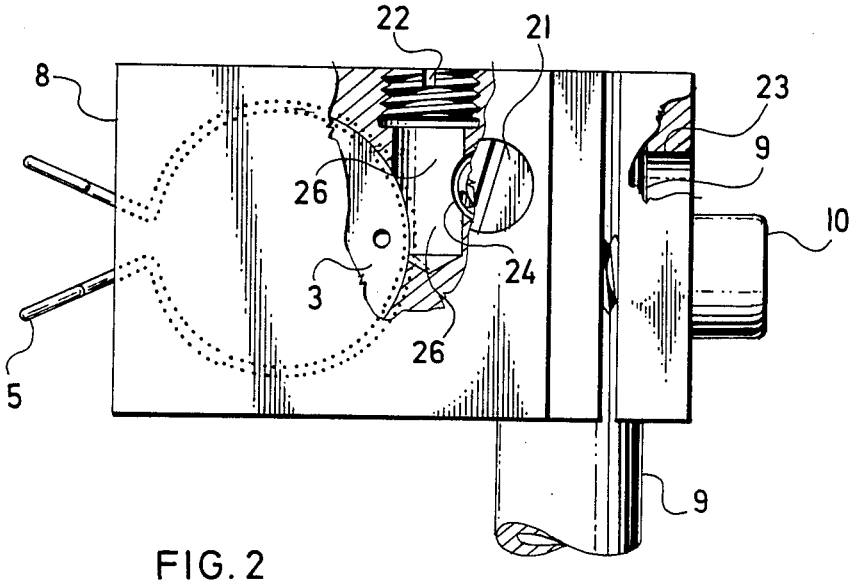
Figure 3:
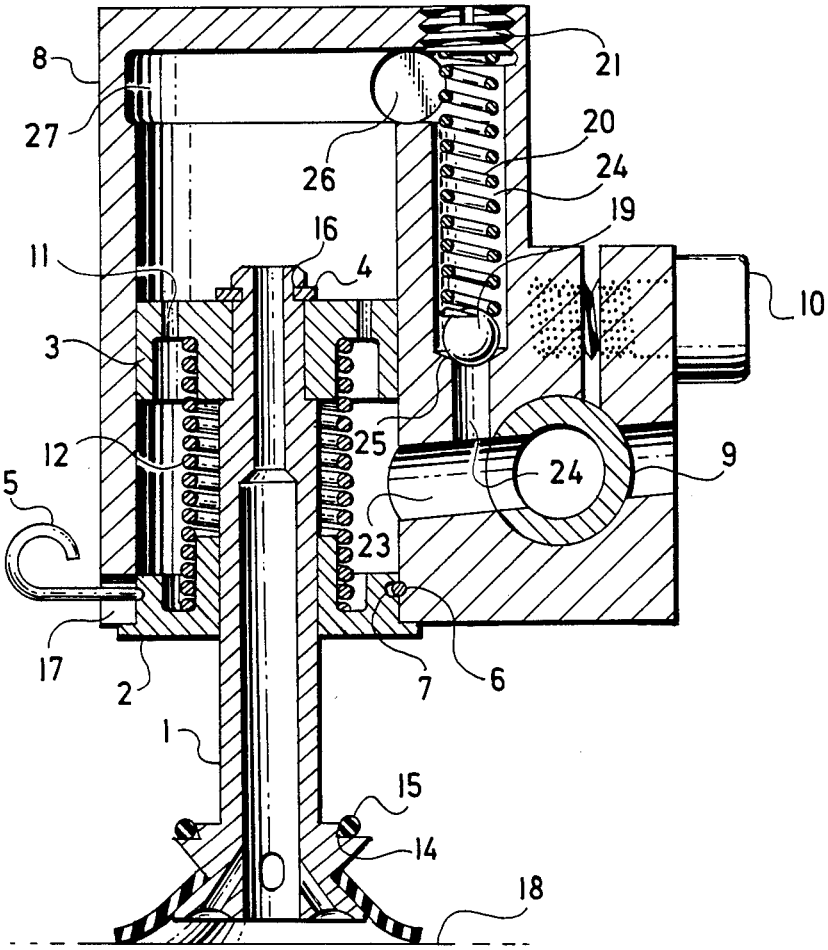
FIG. 3 shows a front view of the suction feeder in longitudinal section at the shifting out of the suction nozzle to the lower forwarding position.
Figure 4:
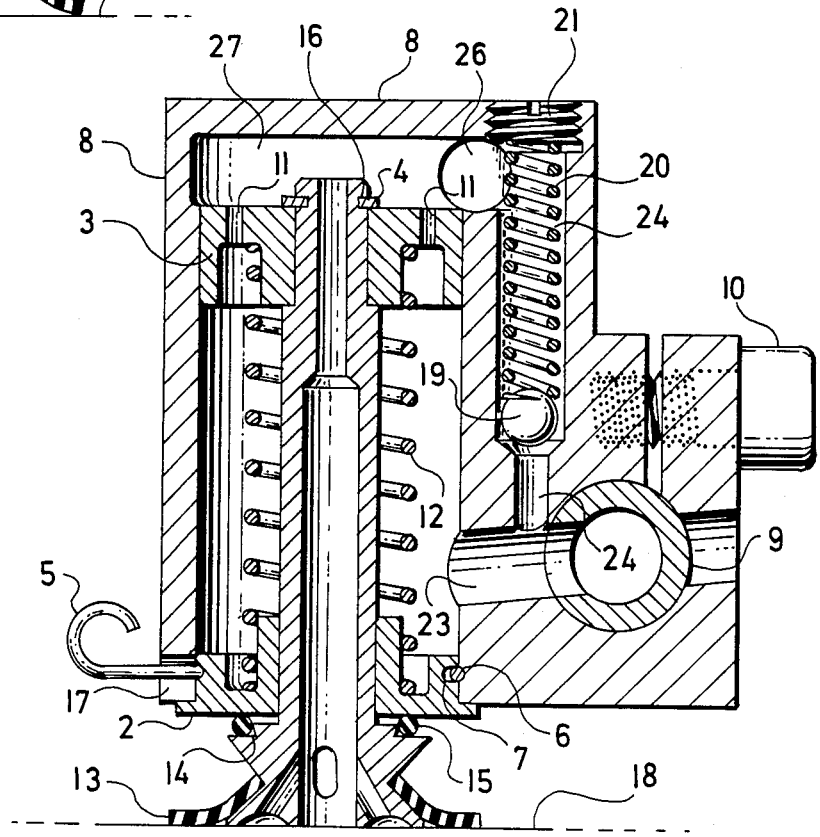
FIG. 4 shows the front view of the suction feeder in the longitudinal section at the shifting in of the suction nozzle to the upper forwarding position with a lifted paper sheet at the beginning of the filling by air of the air filled space, when the small ball is lifted over the seat.

The suction feeder according to the present invention consists of a suction nozzle 1 which is shiftably arranged in a guide bush 2. On the upper shouldered part of the suction nozzle 1, is removably attached a small piston 3 by means of securing ring 4 which is arranged in a connecting recess 16. The guide bush 2 is secured against being shifted out by means of an elastic securing element 5 which is attached in an inner circumferential groove 6 which is formed in the lower part of the suction feeder body 8 and in an outer circumferential groove 7 which is provided in the guide bush 2. The suction feeder body 8 is fastened by means of a screw 10 on a tube 9. In the lower part of the suction feeder body 8 is provided a cut-out 17 for the passing through of the ends of the elastic securing element 5. The small piston 3 is provided with reduction openings 11 which connect the space above and below the small piston 3. On the suction hub of the suction nozzle 1 is attached a suction mouth 13 for the suction of a paper sheet 18. In the seating on part of the suction nozzle 1 is formed a circular groove 14, in which is arranged an elastic stop 15. In the suction feeder body 8 is formed a small conduit channel 24 and an air filling small channel 26 which connect an air inleading small channel 23, for the leading of pressurized air to an air filled space 27 over the small piston 3. In the small conduit channel 24 is provided a seat 25, in which is placed a small ball 19. The small conduit channel 24 is in the upper part closed by a tightening plug 21. In the upper part of the small conduit channel 24 is arranged a pressure spring 20 which seats with one end on the small ball 19 and its other end on the tightening plug 21. The upper part of the small conduit channel 24 over the seat 25 has a larger diameter than its lower part formed below the seat 25. Between the small ball 19 and the larger diameter of the small conduit channel 24 is formed a space for the passing of depressurized air.

The small conduit channel 24, in the sucker body 8, is vertical and parallel to the direction of the movement of the suction nozzle 1. The air filling small channel 26 is vertical to the small conduit channel 24 in such a manner that it forms in the upper part of the sucker body 8, a connecting channel between the air filled space 27 and the small conduit channel 24. The air filling small channel 26 is closed by a tightening plug 22.

The suction feeder described above functions as follows: From the aperture of a valve which is not disclosed in the diagrams, depressurized air enters the sucker body 8 via the tube 9 in the air inleading channel 23. As a result of the difference in air pressure above and below the small piston 3, the suction nozzle 1 is shifted towards the direction of the paper sheet 18, which is sucked onto the suction mouth 13. While the suction nozzle 1 is shifted towards the paper sheet 18 as described above, a lower pressure in the lower part of the small conduit channel 24, causes the small ball 19 to be compressed into seat 25 by pressure spring 20. In this way the pressurized air will enter below the small piston 3. Once the paper is sucked onto the suction mouth 13, the ratios of pressure above and below the small piston 3 cause the pressure spring 12 to compress onto the small piston 3 thereby lifting the suction nozzle 1 with the attached paper sheet 18. While paper sheet 18 is being forwarded, pressurized air is stopped from entering small channel 23. By an air valve, that is not disclosed in the diagrams, the inleading small channel gets opened for a short while by the pressurized air that is led in via tube 9. Pressurized air flows via the inlet small channel 23 into the sucker body 8, over the reduction opening 11, and finally over the small piston 3. Pressurized air simultaneously enters into the small conduit channel 24 and lifts the small ball 19 over the seat 25. From the small conduit channel 24 immediately enters pressurized air via the air filling small channel 26 into the empty space 27 over the small piston 3. In this way, the depressurized air gets instantaneously neutralized, and the paper sheet 18 is instantaneously loosened.

While there has been described a particular embodiment of the invention, it will be apparent to those skilled in the art that variations may be made thereto without departing from the spirit of the invention and the scope of the appended claims.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A suction feeder which has a spring loaded small piston with reduction openings, for the lifting and forwarding of paper sheets, particularly on printing machines, which comprises, a suction feeder body containing a spring loaded small piston a small conduit channel within said body, a seat at one end of said small conduit channel on which is seated a small ball which is located under a pressure spring, said small conduit channel is attached perpendicularly to an air inleading small channel which allows pressurized air to enter said small conduit channel and flow to an air filling small channel which fills an empty space located above said small piston.

2. A suction feeder as described in claim 1, where part of the small conduit channel over the said seat has a larger diameter than under the said seat.

3. A suction feeder as described in claim 2, where between the small ball and the larger diameter of the small conduit channel is left a space for the passing of pressurized air.

4. A suction feeder as described in claim 3, where the small conduit channel in the body of the suction feeder is vertical and parallel with the direction of movement of the suction nozzle, whereby the air filling small channel above the suction feeder body forms a connection between the empty space above the piston and the small conduit channel.

* * * * *